US005346414A

United States Patent [19]

Sakai et al.

[11] Patent Number: 5,346,414

[45] Date of Patent: Sep. 13, 1994

[54] CONSTRUCTION OF REAR HOLDER FOR CONNECTOR CAPABLE TO BE DRAWN OUT

[75] Inventors: Hitoshi Sakai; Hitoshi Saitoh; Osamu Sugiyama, all of Shizuoka, Japan

[73] Assignee: Yazaki Corporation, Tokyo, Japan

[21] Appl. No.: 94,232

[22] Filed: Jul. 21, 1993

[30] Foreign Application Priority Data

Aug. 10, 1992 [JP] Japan ..... 4-055998[U]

[51] Int. Cl.[5] ..... H01R 13/514

[52] U.S. Cl. ..... 439/752; 439/595

[58] Field of Search ..... 439/595, 596, 598, 599, 439/752, 701, 350, 353, 357

[56] References Cited

U.S. PATENT DOCUMENTS 4,557,542 12/1985 Collier et al. ..... 439/595

5,145,411 9/1992 Pastal et al. ..... 439/598

FOREIGN PATENT DOCUMENTS 63-80773 5/1988 Japan .

3-29890 6/1991 Japan .

*Primary Examiner*—Eugene F. Desmond

*Attorney, Agent, or Firm*—Jacobson, Price, Holman & Stern

[57] ABSTRACT

A construction of a rear holder for a connector capable to be drawn out that comprises a connector housing, connector terminals and a rear holder accompanied with a means for pulling the rear holder out, the rear holder as a stopper for movement of the terminals being inserted into the housing from a opening behind and engaging with the housing by means of projections on the holder and holes in the upper wall of the housing, is characterised by a channel with a pit at the front bottom forming a supporter step for the means, which the means for pulling the rear holder out is easily inserted into.

7 Claims, 4 Drawing Sheets

CONSTRUCTION OF REAR HOLDER FOR CONNECTOR CAPABLE TO BE DRAWN OUT

BACKGROUND OF THE INVENTION

1. Field of the Invention

The present invention relates to a construction of a rear holder for a connector capable to be drawn out, which can be easily separated from a connector housing, while the holder being used in order to prevent connector terminals, which are disposed in the connector housing, to move behind.

2. Description of the Prior Art

Japanese Utility Model Laid-open No. 80773/88 discloses a construction of a rear holder for a connector, comprising of a connector housing of plastic, which accommodates connector terminals inside, and a rear holder of plastic plates which being inserted into the housing from a rear opening until to touch with rear ends of the connector terminals, and being engaged with the housing when touched with the terminals.

On the upper surface of the rear holder are arranged a pair of projections for engagements with the housing, and on the lower surface in the front part of the rear holder is formed a notched stage where the every rear part of the terminals can enter. In the upper wall in the area near the rear end of the connector housing are arranged a pair of holes for engaging with the pair of projections of the rear holder. The terminals are stopped to move behind by engagements with a flexible lance placed at the midway of the terminals in the container chamber for the terminals in the housing, and are also engaging with the rear holder to be stopped doubly.

By the construction of the prior art, a means for pulling the rear holder out, which has a shape of a bar with a tipped end, is inserted between the housing and the rear holder along the upper surface of the holder, and wrenches the upper wall of the housing in order to unfasten an engagement of one couple of the projections and the holes, when required to pull the holder out. But often fails the operation to pull the holder out because of slipping of the means or breakage in the housing by over-wrenching. Moreover often happens an unexpected failure that an engagement of one couple of the projections and the holes, which has once been unfastened, recovers to be engaged by the operation for unfastening the engagement of the another couple.

SUMMARY OF THE INVENTION

It is an object of the present invention to provide a construction of a rear holder for a connector capable to be drawn out, under which the rear holder can be easily and smoothly drawn out of the connector by overcoming the above-mentioned bad operability.

To achieve the above-mentioned object, the present invention provides a construction of a rear holder for a connector capable to be drawn out with the help of a means for pulling the rear holder out, said means having a shape of a bar with a tipped end, said rear holder as a stopper for movement of connector terminals being inserted into a connector housing from a opening behind and engaging with said housing by means of projections on the holder and holes in the upper wall of the housing, comprising a channel with a pit at the front bottom, said channel being scooped in the structure constituted with said upper wall and said rear holder from the back.

When required to pull the rear holder out, the means for pulling the rear holder out is inserted into the channel between the wall and the rear holder, and turned to upward in order to wrench the wall of the housing, applying the action of levers supported at the upper edge of the behind wall of the pit, with sliding of the tipped end of the means on the bottom surface of the pit, so that the engagements between the projections and the holes being unfastened and the rear holder being drawn behind.

The forgoing and other objects, features and advantages will be apparent from the following description of the preferred embodiment of the present invention as illustrated in the accompanying drawings.

DESCRIPTION OF THE PREFERRED EMBODIMENT

Figure 1A:
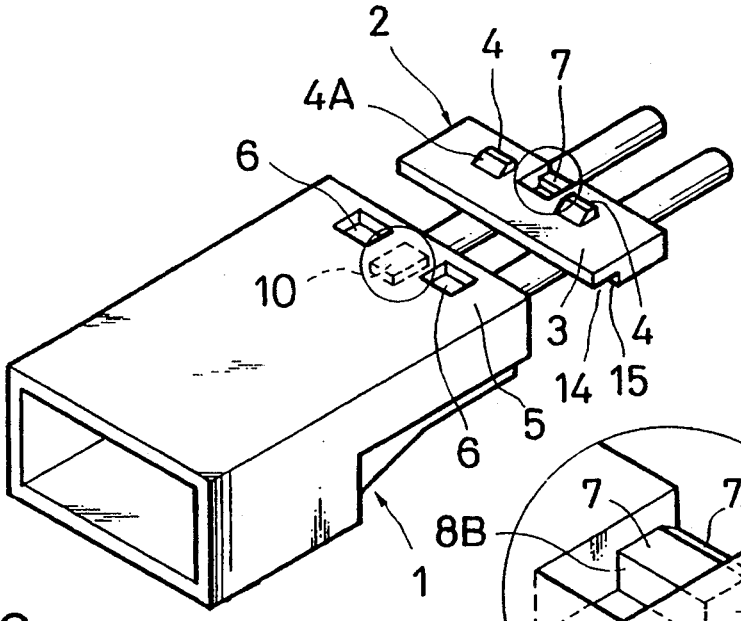
FIG. 1 is a separately positioned perspective view of a rear holder and a connector housing with enlarged sectional views which illustrate an embodiment of a construction of the present invention.
Figure 1B:
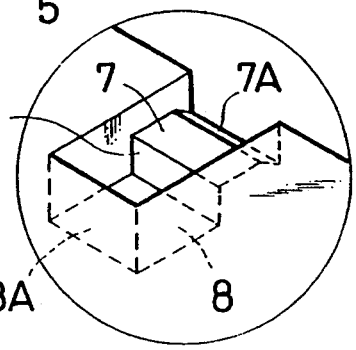
Figure 1C:
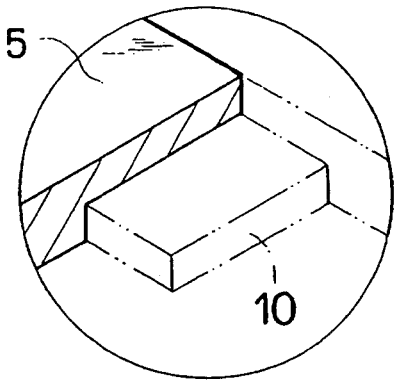

Referring to FIG. 1, the separately positioned perspective view of the rear holder and the connector housing of an embodiment of the present invention is shown. Also referring to FIG. 2, the vertical cross sectional view of the assembled connector as in FIG. 1 is shown.

The connector comprises a connector housing 1 of plastic, and a rear holder 2 of plastic. On the upper surface 3 of the rear holder 2 are arranged a pair of projections 4 for engagements with the housing 1, shaped nearly rectangular, similar to the prior art. In the upper wall 5 in the area near the rear end of the connector housing 1 are arranged a pair of holes 6 with a shape of also nearly rectangular, engaging with the projections 4 respectively when assembled.

On the rear holder 2 at the center of the pair of the projections 4 is scooped a gutter 7 with a pit 8 at the front bottom from the back, which constitute a lower part of a channel 9 placed in the structure of the upper wall 5 and the rear holder 2. The channel 9 comprises the gutter 7 and a hollow way 10 which is scooped in the upper wall 5 of the housing 1 and is adjacent to the gutter 7 when assembled. The length of the hollow way 10 is longer than the length of the gutter 7 but nearly equal. The front end of the gutter 7 is disposed at a line underneath the front tapered surface 4A of the projections 4 when assembled. The vertical sections of the channel 9 of assembled state are rectangular, so that the vertical sections of the gutter 7 and the hollow way 10 are also rectangular respectively. The pit 8 has a flat bottom surface so that a tipped end 11A of a means 11 for pulling the rear holder 2 out may be slidden. The pit 8 has a vertical front wall 8A, and a vertical behind wall 8B to form a step for supporting of lever action to wrench the upper wall 5 and for receiving of forces to a consecutive action to pull out the rear holder 2 behind. The gutter 7 has a sloped bottom surface 7A as to be a guiding surface and to form a opening enlarged for the means 11 to be easily inserted from the back.

The depths of the gutter 7 (excluding the pit 8) and the hollow way 10 are nearly equal and the total depth of the both, that is the depth of the channel 9, is almost as much as of the means 11, on the other hand the pit 8 has a depth of nearly three (3) times of the gutter 7.

Figure 2:
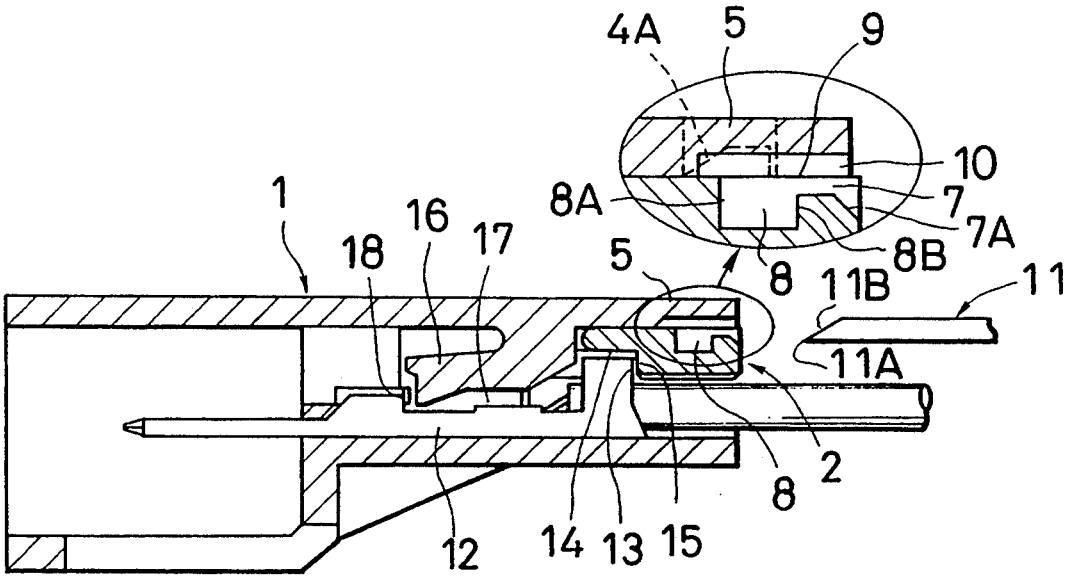
FIG. 2 is a vertical cross sectional view of an assembled connector as in FIG. 1 with a enlarged sectional view.

In FIG. 2 are shown connector terminals 12 similar to the prior art with rear ends 13, which enter underneath a notched stage 14 of the rear holder 2 and touch with a step 15 at the behind end of the notched stage 14 when assembled. A flexible lance 16, also similar to the prior art, is placed at the midway of the terminals in the container chamber 17 for the terminals 12 in the housing 1 in order to stop the terminals to move behind by the engagement with a midway step 18. The terminals 12 are doubly stopped to move behind with the lance 16 and the rear holder 2.

The means 11 is made from a material like a metal, having a shape of a bar of rectangular section with a tipped end 11A formed by a tapered surface 11B, which makes the means 11 easily enter to the channel 9 (or the gap between the rear holder 2 and the upper wall 5 of the housing 1 in the case of the prior art).

Figure 3:
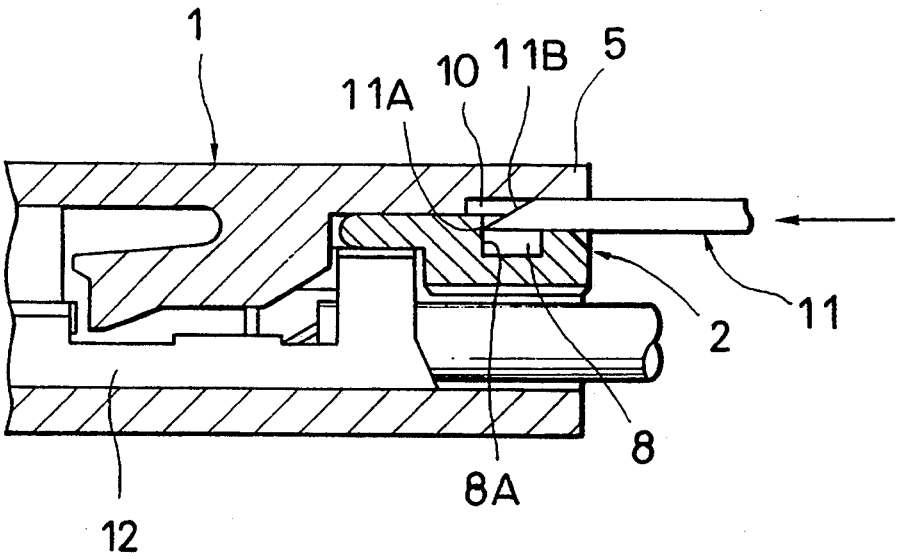
FIG. 3 is a vertical cross sectional view of the rear part of the connector showing a means for pulling the rear holder out inserted in a channel in accordance with the present invention.
Figure 4:
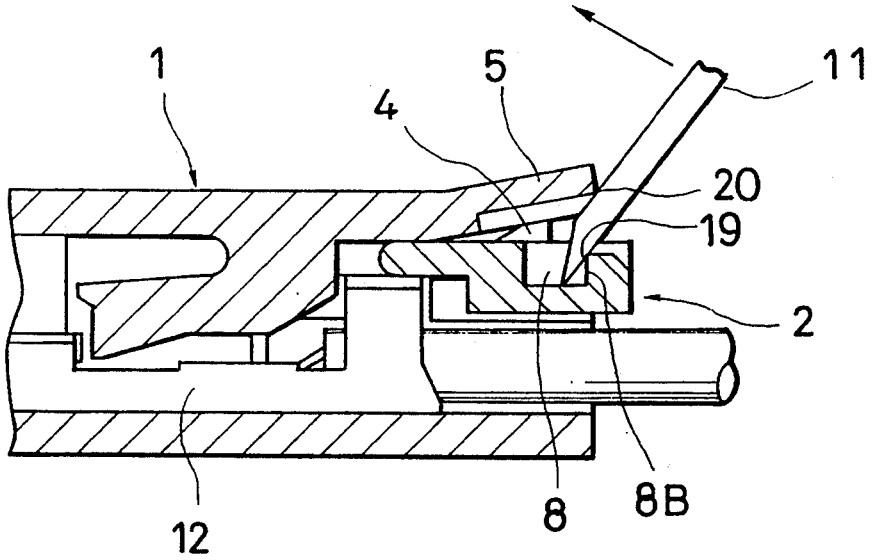
FIG. 4 is a vertical cross sectional view as in FIG. 3 showing the means turned upward and the rear holder being drawn out.
Figure 5:
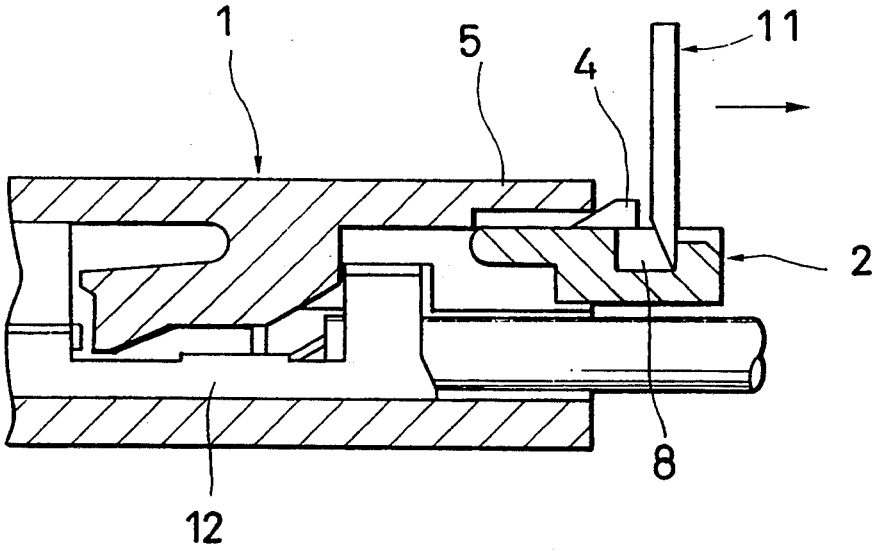
FIG. 5 is a vertical cross sectional view as in FIG. 3 showing the rear holder having been drawn out.

Referring to FIG. 3, 4 and 5, the progress for pulling the rear holder out can be seen. For the first step of pulling the rear holder out, the means 11 is inserted into the channel 9 until the tipped end 11A reaches to the front wall 8A, with the tapered surface 11B directed upwardly (faced against the upper wall 5 of the housing 1) as shown in FIG. 3. For the next step, the means 11 is pulled up to rotate around the contacted point 19 with the upper edge of the behind wall 8B as shown in FIG. 4. The tipped end 11A turns into the pit 8, at the same time the means 11 pushes the upper rear edge 20 of the hollow way 10 (the lower edge of the upper wall 5 at the channel 9). Consequently the upper wall 5 is wrenched and bent, and the engagements of the projections 4 and the holes 6 are unfastened, and the rear holder 2 is drawn out behind by the turning action of the means 11 supported at the upper rear edge 20. FIG. 5 shows the completion of the drawing action of the rear holder 2 out.

According to the present invention that is a connector with a rear holder provided with a channel with a pit, which a means for pulling the rear holder out may be inserted into, the engagements of projections on the rear holder and holes in the upper wall of the connector housing can be easily unfastened by wrenching the rear part of the upper wall, applying the action of levers with the means, and the rear holder can be easily drawn out of the connector housing. Consequently the operation of removing the rear holder out of the connector can be easily and smoothly done. With this, the improvement of the operability and the prevention of the breakage of the housing have been achieved.

Figure 6:
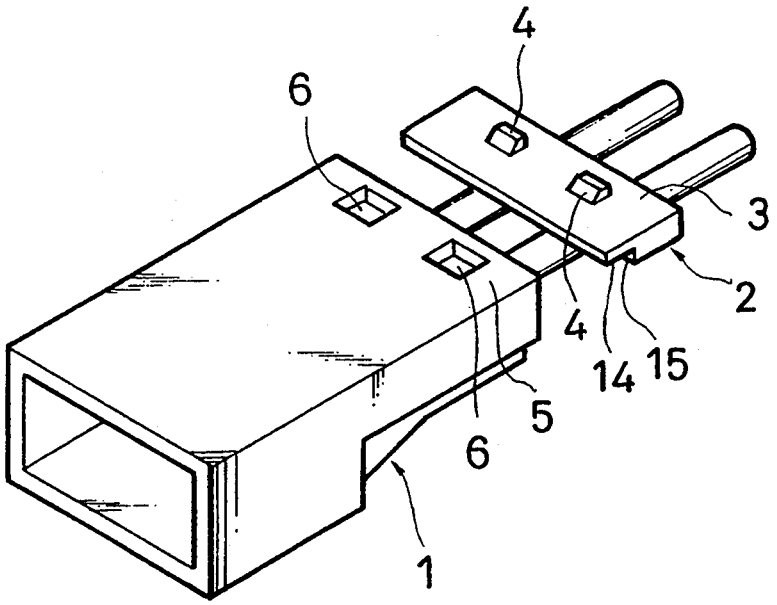
FIG. 6 is a separately positioned perspective view of a rear holder and a connector housing according to the prior art.
Figure 7:
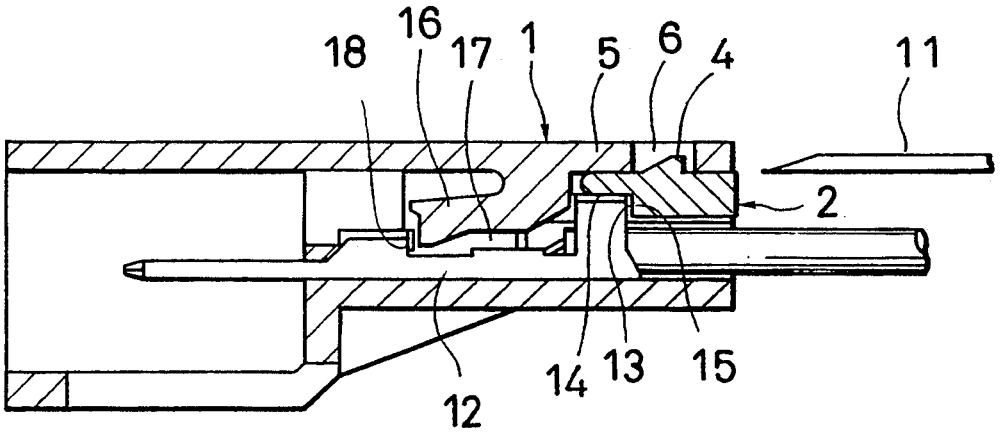
FIG. 7 is a vertical cross sectional view of an assembled connector as in FIG. 6.

Referring to FIG. 6 and 7, a connector by the prior art is shown by the same referring numbers for identical parts with the above-mentioned embodiment. Constructions of the prior art and the present invention are identical except connections with the channel 9.

It will be understood that the channel 9 in the above-mentioned example can be placed only in either of the rear holder 2 or the upper wall 5. It will also be understood that the engagement(s) of the projection(s) 4 and the hole(s) 6 which are described as a pair in the above-mentioned embodiment can be a single or more than a pair. In the case of a single, the channel 9 with the pit 8 may preferably be provided at the place near the engagement. In the case of more than a pair, the channel 9 may preferably be provided at the place near the center of the engagements.

It will therefore be apparent to one skilled in the art that many variation in form and detail may be made in the preferred embodiment without varying from the spirit and scope of the invention as defined in the claim. The preferred embodiment is thus provided for purposes of explanation and illustration, but not limitation.

What is claimed is:

1. A construction of a rear holder for a connector capable to be drawn out with help of means for pulling the rear holder out, said means having a shape of a bar with a tipped end, said rear holder as a stopper for movement of connector terminals being inserted into a connector housing from a opening behind and engaging with said housing by means-of at least a projection on-the holder and a hole in the upper wall of the housing, comprising a channel with a pit at the front bottom, said channel being scooped in the structure constituted with said upper wall and said rear holder from the back.

2. A construction of a rear holder according to claim 1 wherein respective scooped depth of said channel except the pit in said upper wall and said rear holder being equal with each other and nearly equal with a half of the thickness of said means for pulling the rear holder out.

3. A construction of a rear holder according to claim 1 wherein said channel being scooped only in said rear holder.

4. A construction of a rear holder according to claim 1 wherein said channel except the pit being scooped only in said upper wall of the housing.

5. A construction of a rear holder according to claim 1 wherein said channel having a sloped bottom surface to form a enlarged opening behind.

6. A construction of a rear holder according to claim 1 wherein said channel being scooped near the engaging means of a projection on the holder and a hole in the upper wall when the engaging means being single.

7. A construction of a rear holder according to claim 1 wherein said channel being scooped near center of any two adjacent engaging means of projections on the holder and holes in the upper wall when the engaging means being plural.

* * * * *